US005347366A

United States Patent [19]

Ham

[11] Patent Number: 5,347,366

[45] Date of Patent: Sep. 13, 1994

[54] FIXATION STRUCTURE OF DEFLECTION YOKE AND FOCUS MAGNET FOR PROJECTION CATHODE RAY TUBE

[75] Inventor: Sungwoo Ham, Suwon, Rep. of Korea

[73] Assignee: Samsung Electron Devices Co., Ltd., Kyunggi, Rep. of Korea

[21] Appl. No.: 67,570

[22] Filed: May 25, 1993

[30] Foreign Application Priority Data

Nov. 10, 1992 [KR] Rep. of Korea ..... 92-21044

[51] Int. Cl.[5] ..... H01H 5/00

[52] U.S. Cl. ..... 348/829; 335/213; 313/440; 313/442

[58] Field of Search ..... 358/248; 335/213; 313/442, 440, 482

[56] References Cited

U.S. PATENT DOCUMENTS

| | | | |
|---|---|---|---|
| 3,761,848 | 9/1973 | Sugiura | 335/210 |
| 3,939,447 | 2/1976 | D'Amato | 335/210 |
| 5,124,613 | 6/1992 | Park et al. | 313/440 |
| 5,191,253 | 3/1993 | Kang | 313/440 |
| 5,204,648 | 4/1993 | Jei | 335/213 |

FOREIGN PATENT DOCUMENTS

| | | |
|---|---|---|
| 61-7703 | 3/1986 | Japan . |
| 62-7658 | 4/1987 | Japan . |
| 62-100935 | 5/1987 | Japan . |
| 62-223952 | 10/1987 | Japan . |
| 64-45046 | 2/1989 | Japan . |

*Primary Examiner*—Edward L. Coles, Sr.
*Assistant Examiner*—Thomas L. Stoll
*Attorney, Agent, or Firm*—Christie, Parker & Hale

[57] ABSTRACT

A structure for fixing a deflection yoke and a focus magnet on the periphery of a projection cathode ray tube. A fixing part of the focus magnet and a fixing part of the deflection yoke are overlapped and these two fixing parts are fixed on the periphery of the tube by one common clamp.

3 Claims, 3 Drawing Sheets

FIXATION STRUCTURE OF DEFLECTION YOKE AND FOCUS MAGNET FOR PROJECTION CATHODE RAY TUBE

BACKGROUND OF THE INVENTION

1. Field of the Invention

The present invention relates to a structure for fixation of a deflection yoke and a focus magnet used in a projection cathode ray tube CRT and, more particularly, to the fixation structure of the deflection yoke and the focus magnet capable of improving resolution of the projection CRT by lessening the magnification of a magnetic lens formed by the focus magnet.

2. Description of the Related Art

In the projection CRT, electron beams emitted from an electron gun mounted within the neck portion thereof form a considerably strong image on a screen of the tube. This image is enlarged through an optical system to be projected on a viewing screen.

The projection CRT has the size of normally about 5 to 7 inches and small size as compared with an ordinary CRT, but needs high brightness and resolution.

FIG. 3 illustrates schematically a conventional projection CRT. AS shown in this figure, a focus magnet 30 for focusing electron beams injected from the electron gun is mounted on the periphery of neck portion 50 of a tube. A deflection yoke 20 for deflecting the electron beams is mounted on the periphery of the funnel portion 12 of the tube. The focus magnet 30 and the deflection yoke 20 are fixed on the outside surface of the tube by clamps 34, 24, respectively.

A method of fixing the focus magnet and the deflection yoke by separate clamps 34, 24 shows low precision. In particular, misalignment between the central axes of the electron beams and that of the focus magnet 30 and the deflection yoke 20 can occur. At that time, a beam spot cannot be accurately formed on the screen.

In the meantime, in case that $R_d$ indicates the beam diameter, M indicates the magnetic lens magnification, and X indicates the virtual crossover by the electron gun, $$R_d = M \times X.$$

As the diameter of the electron beam gets smaller, the picture resolution gets better.

In the projection CRT, the focusing characteristic is theoretically the best when the dimensional ratio of a crossover and an image. The is because, in the case of constant distances in the crossover, the lens and the image, to enlarge the magnification ratio of the lens, the lens thickness should be thickened, resulting in an increased spherical aberration.

As shown in FIG. 3, in case that a indicates the distance from the virtual crossover 46 of the electron gun to the center of the magnetic lens 36 formed by the focus magnet 30 and b indicates the distance from the lens center to the screen, the lens magnification M is shown as: $M = b/a$. Thus, if $a = b$, $M = 1$. At that time, the optimum resolution can be obtained.

Thus, it can be seen that, in the projection CRT, the focus magnet 30 is disposed nearer to the screen to obtain a better resolution.

A conventional method for disposing the focus magnet 30 near the screen 10 is to lengthen the overall length of the neck portion 50. However, this method goes against the tendency of the compact projection CRT and also, there is difficulty in the manufacturing process of the tubes, which results in increased production costs.

SUMMARY OF THE INVENTION

To solve conventional technical problems, an object of the present invention is to provide a fixation structure of a focus magnet and a deflection yoke for use in an improved projection cathode ray tube CRT.

According to the present invention, there is provided a fixation structure of the deflection yoke and the focus magnet for use in the projection CRT, including an electron gun installed within the neck portion of the tube emitting electron beams, the focus magnet being mounted on the periphery of the neck portion of the tube, and the deflection yoke being mounted on the periphery of a funnel portion of the tube deflecting the electron beams, wherein a fixing part of the focus magnet is overlapped on a fixing part of the deflection yoke and these fixing parts are mounted on the periphery of the tube by one common clamp.

BRIEF DESCRIPTION OF THE DRAWINGS

Further objects and other advantages of the present invention will be apparent from the detailed description of the preferred embodiment in connection with the accompanying drawings.

DESCRIPTION OF THE PREFERRED EMBODIMENTS

Figure 1:
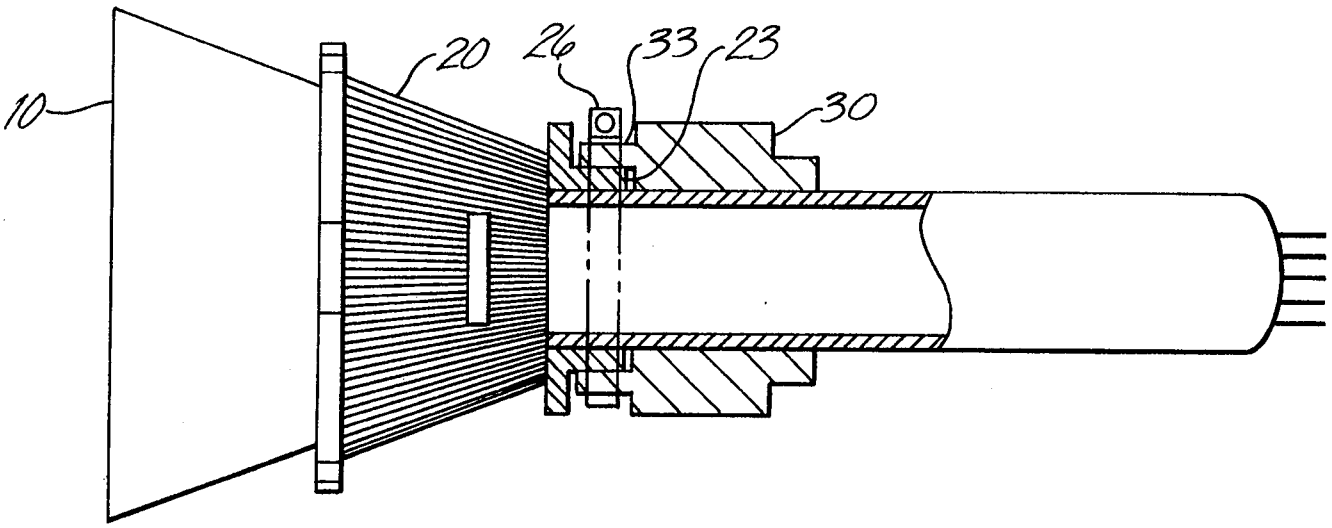
FIG. 1 is a schematic partial side sectional view of one embodiment of a fixation structure of the present invention.

FIG. 1 shows in a schematic partial side sectional view, one embodiment of a fixation structure of a deflection yoke and a focus magnet for used in a projection cathode ray tube CRT. As shown in this figure, a fixing part 33 of the focus magnet 30 is overlapped on the outside of a fixing part 23 of the deflection yoke 20 and these two fixing parts 33 and 23 are fixed on the periphery of the tube by one common clamp 24.

Figure 2:
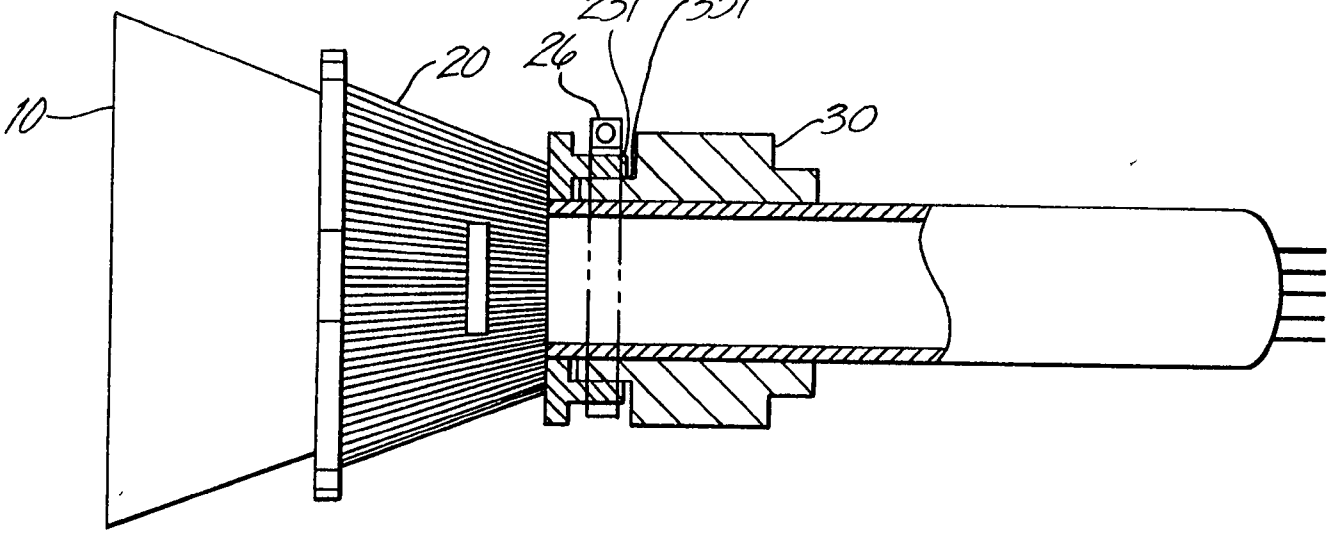
FIG. 2 is a schematic partial sectional side view of another embodiment of a fixation structure of FIG. 1.
Figure 3:
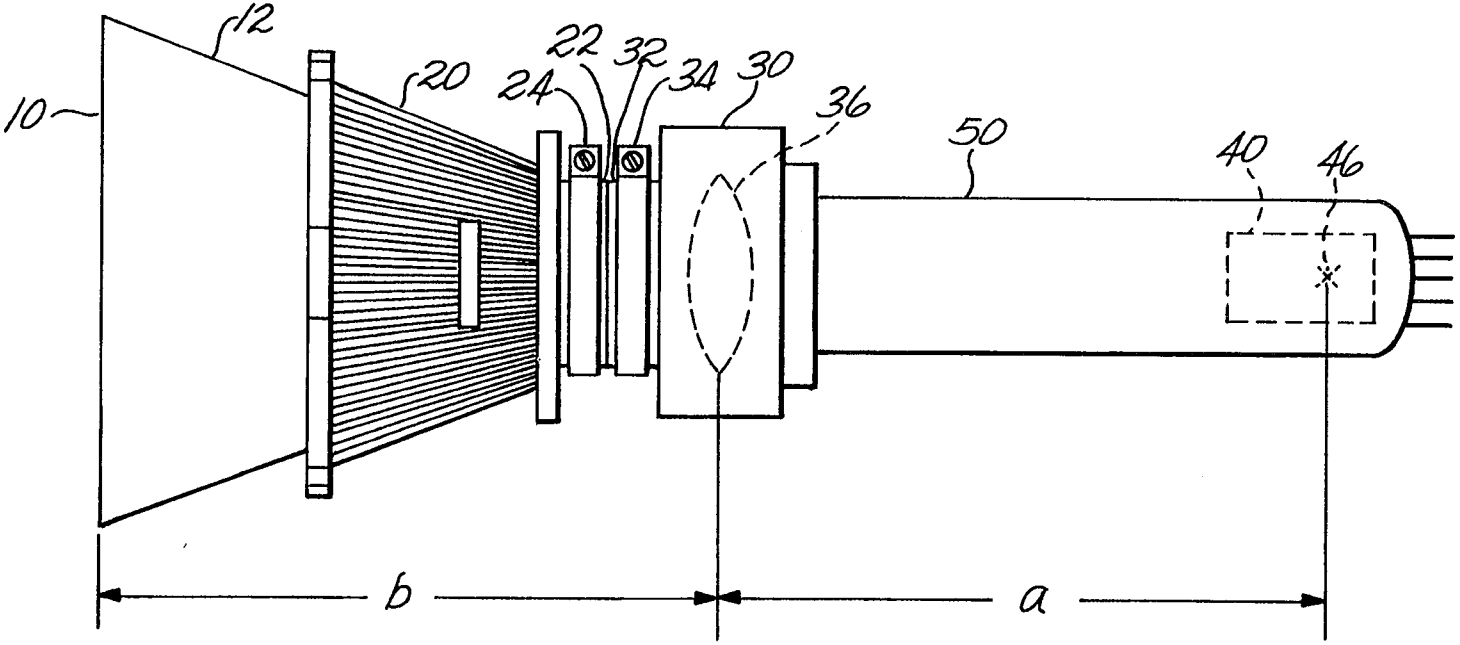
Fig. 3 (PRIOR ART)
FIG. 3 is a schematic side view of a fixation structure for use in a conventional projection cathode ray tube.

FIG. 2 is different from FIG. 1 in that the fixing part 331 of the focus magnet 30 is overlapped on the inside of the fixing part 231 of the deflection yoke 20.

While each individual clamp 24 and 34 fastens the focus magnet 30 and the deflection yoke 20 in a conventional projection CRT, the present projection CRT uses only one common clamp 26;261 to fasten them at the same time, resulting in the following advantages.

(A) The picture resolution is improved.

Conventionally, two fixing parts 22, 32 are in serial disposed on the neck portion 50 of the tube. But, in the present invention, as one fixing part 33 or 23 is overlapped on another fixing part 23 or 33, the overall length of the neck portion is constantly maintained, the focus magnet 30 can be disposed nearer to the screen 10. Thus, a (distance from the virtual crossover 46 of the electron gun 40 to the center of the magnetic lens 36 formed by the focus magnet 30) is enlarged and b (distance from the center of the lens 36 to the screen 10) is lessened, whereby the lens magnification M ($M = b/a$) is lessened.

In case of a 7" sized projection CRT, while the value of M in the conventional projection CRT is 160 MM/140 mm = 1.13, the value of M in the projection CRT of the present invention is 150 mm/150 mm = 1. This being the best optimum, the lens magnification of the present invention is reduced by about 11.5% as compared with that in the conventional projection CRT. When the electric current of 350 μA is applied to the focus magnet, the beam diameter of the present invention is measured at 260 μm as compared with the conventional beam diameter of 290 μm. The beam lens is reduced at more than 10%, so that the picture resolution can be improved.

(B) The focus magnet and the deflection yoke can be more accurately mounted on the periphery of the tube, so that the positional accuracy of the beam spot formed on the screen by the electron beam is improved.

(C) Only one clamp is used, so that the projection CRT is to be compact and the production cost is to be reduced.

Although the preferred embodiments of this invention have been described in detail, it should be clearly understood that many variations or modifications of the basic inventive concepts here taught will still fall within the spirit and scope of the present invention, as defined in the appended claims.

What is claimed is:

1. A structure for fixation of a deflection yoke and a focus magnet used in a projection cathode ray tube including an electron gun installed within a neck portion of the tube emitting electron beams, the focus magnet mounted on the periphery of the neck portion of the tube and the deflection yoke mounted on the periphery of a funnel portion of the tube deflecting the electron beams, a fixing part of the focus magnet and a fixing part of the deflection yoke being overlapped and these fixing parts being mounted on the periphery of the tube by one common clamp.

2. The structure for fixation as claimed in claim 1, wherein the fixing part of the focus magnet is overlapped on the outside of the fixing part of the deflection yoke.

3. The structure for fixation as claimed in claim 1, wherein the fixing part of the focus magnet is overlapped on the inside of the fixing part of the deflection yoke.

* * * * *